US008112017B2

(12) United States Patent
Hatakeyama et al.

(10) Patent No.: US 8,112,017 B2
(45) **Date of Patent: *Feb. 7, 2012**

(54) DEVELOPING UNIT AND DEVELOPER STIRRING AND TRANSPORTING METHOD

(75) Inventors: Takashi Hatakeyama, Kanagawa-ken (JP); Hiroshi Murata, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/816,548

(22) Filed: Jun. 16, 2010

(65) Prior Publication Data

US 2010/0254729 A1 Oct. 7, 2010

Related U.S. Application Data

(63) Continuation of application No. 11/479,827, filed on Jun. 30, 2006, now Pat. No. 7,764,908.

(51) Int. Cl.
*G03G 15/08* (2006.01)

(52) U.S. Cl. ..... 399/254; 399/256; 399/260

(58) Field of Classification Search ..... 399/254
See application file for complete search history.

(56) References Cited

U.S. PATENT DOCUMENTS 5,572,300 A 11/1996 Yamasa et al.
2006/0062599 A1 3/2006 Shimmura et al.

FOREIGN PATENT DOCUMENTS

JP 2000-081787 3/2000

OTHER PUBLICATIONS

Office Action for U.S. Appl. No. 11/479,827 mailed on Jul. 22, 2009.

*Primary Examiner* — David Gray
*Assistant Examiner* — Andrew Do
(74) *Attorney, Agent, or Firm* — Turocy & Watson, LLP

(57) ABSTRACT

There are provided a developing unit and a developer stirring and transporting method in which the amount of developer in the developing unit can always be kept at a specified amount without being influenced by a use environment. A developing unit 10 includes a developing roller 12, a containing unit 16 to contain the developer and having a discharge port 14 to discharge the overflown developer in its side wall, a stirring and transporting member 20 to stir and transport the developer along a passage 18 formed in the containing unit 16, and a guide unit 22 provided in the passage 18 correspondingly to the discharge port 14 of the containing unit 16 and to guide the developer transported in the passage 18 by the stirring and transporting member 20 to the discharge port 14 side.

9 Claims, 15 Drawing Sheets

MODE 5

DEVELOPING UNIT AND DEVELOPER STIRRING AND TRANSPORTING METHOD

CROSS-REFERENCE TO RELATED APPLICATION

This application is a Continuation of application Ser. No. 11/479,827 filed on Jun. 30, 2006, the entire contents of both of which are incorporated herein by reference.

BACKGROUND OF THE INVENTION

1. Field of the Invention

The present invention relates to a developing unit and a developer stirring and transporting method.

2. Description of the Related Art

Heretofore, as something to discharge a developer in a developing unit from the developing unit, there is one to discharge a developer by overflow from a developer discharge port formed in a side wall of the developer. In this structure as stated above, there is known a technique in which in order to cause the overflow more easily, in a second stirring and transporting member to stir and transport a developer, a rotary wing in the vicinity of the developer discharge port is changed to a rotary wing with a transporting force lower than normal, so that the developer top surface height in the vicinity of the developer discharge port becomes locally higher than that in another area (see, for example, JP-A-2000-81787).

However, since the fluidity of the developer is changed according to the use environment, according to what is disclosed in the related art, for example, when used in a high humidity environment such as a temperature of 30° C. and a humidity of 80%, the developer contains water, the fluidity becomes poor, and it becomes hard to discharge. Thus, there arises a disadvantage that the developer is accumulated more than necessary, and it is not discharged unless the volume is much increased. Besides, since the amount of surplus developer discharged becomes smaller than the amount of developer supplied into the developing unit, the amount of developer contained in the developing unit is significantly increased, and the developer can leak from the developing unit. Thus, it becomes necessary to enlarge the developing unit more than necessary in expectation of the amount of developer increased in the developing unit. Besides, with the increase of the developer, the stirring performance is lowered, and therefore, an insufficiency of density is caused, and it becomes difficult to keep high picture quality.

SUMMARY OF THE INVENTION

The invention has an object to provide a developing unit and a developer stirring and transporting method in which the amount of developer in the developing unit can always be kept at a specified amount without being influenced by a use environment.

In order to solve the problem, a developing unit according to an aspect of the invention has a following structure and includes a developer supply member configured to supply a developer to an image bearing body, a containing unit configured to contain the developer supplied to the developer supply member and having a discharge port to discharge the overflown developer in a side wall, a stirring and transporting member configured to stir and transport the developer along a passage formed in the containing unit, and a guide unit provided in the passage correspondingly to the discharge port and configured to guide the developer transported in the passage by the stirring and transporting member to the discharge port side.

Besides, a developing unit according to an aspect of the invention has a following structure and includes developer supply means for supplying a developer to image bearing means, developer containing means for containing the developer supplied to the developer supply member and having a discharge port to discharge the overflown developer in a side wall, stirring and transporting means for stirring and transporting the developer along a passage formed in the developer containing means, and guide means provided in the passage correspondingly to the discharge port of the developer containing means and for guiding the developer transported in the passage by the stirring and transporting means to the discharge port side.

Further, a developer stirring and transporting method according to an aspect of the invention has a following structure and includes stirring and transporting a developer in a container to contain the developer, guiding the developer flowing in a transport passage to a discharge port, and discharging the overflown developer through the discharge port.

According to the structure as described above, even in the case where the fluidity of the developer is poor in a high humidity environment or the like, since the flow of the developer to the discharge port direction is guided and formed, the surplus developer is positively discharged through the discharge port. Accordingly, the amount of developer in the developing unit can always be kept at a specified amount without being influenced by a use environment.

Accordingly, in the case where the use environment is a high humidity state, although the leakage of a developer from a developing unit conventionally occurs due to the increase of the developer in the developing unit, and the developing unit is enlarged more than necessary in order to prevent this, such disadvantage can be eliminated. Besides, it is possible to solve such problems that the stirring performance is lowered by the increase of the developer in the developing unit, the uneven density is caused, and a high picture quality can not be kept.

DESCRIPTION OF THE DRAWINGS

FIG. 2(*b*) is a C-C sectional view of FIG. 2(*a*).

FIG. 5(*b*) is a C-C sectional view of FIG. 5(*a*).

FIG. 8(*b*) is a C-C sectional view of FIG. 8(*a*).

FIG. 17(*b*) is a C-C sectional view of FIG. 17(*a*).

DESCRIPTION OF THE EMBODIMENTS

In embodiments of the invention, a description will be given to a developing system in which a new carrier is supplied into a developing unit little by little at the same time as the supply of toner consumed, and a surplus developer is made to overflow through a discharge port in a wall surface of the developing unit. By this, the deteriorated developer is replaced by the new toner and carrier, the developing performance is kept, and a reduction in picture quality can be suppressed. Besides, in this system, since it is not necessary to replace the developer collectively, excellent maintenance can be kept.

Hereinafter, embodiments of the invention will be described with reference to the drawings.

Embodiment 1

Figure 1:
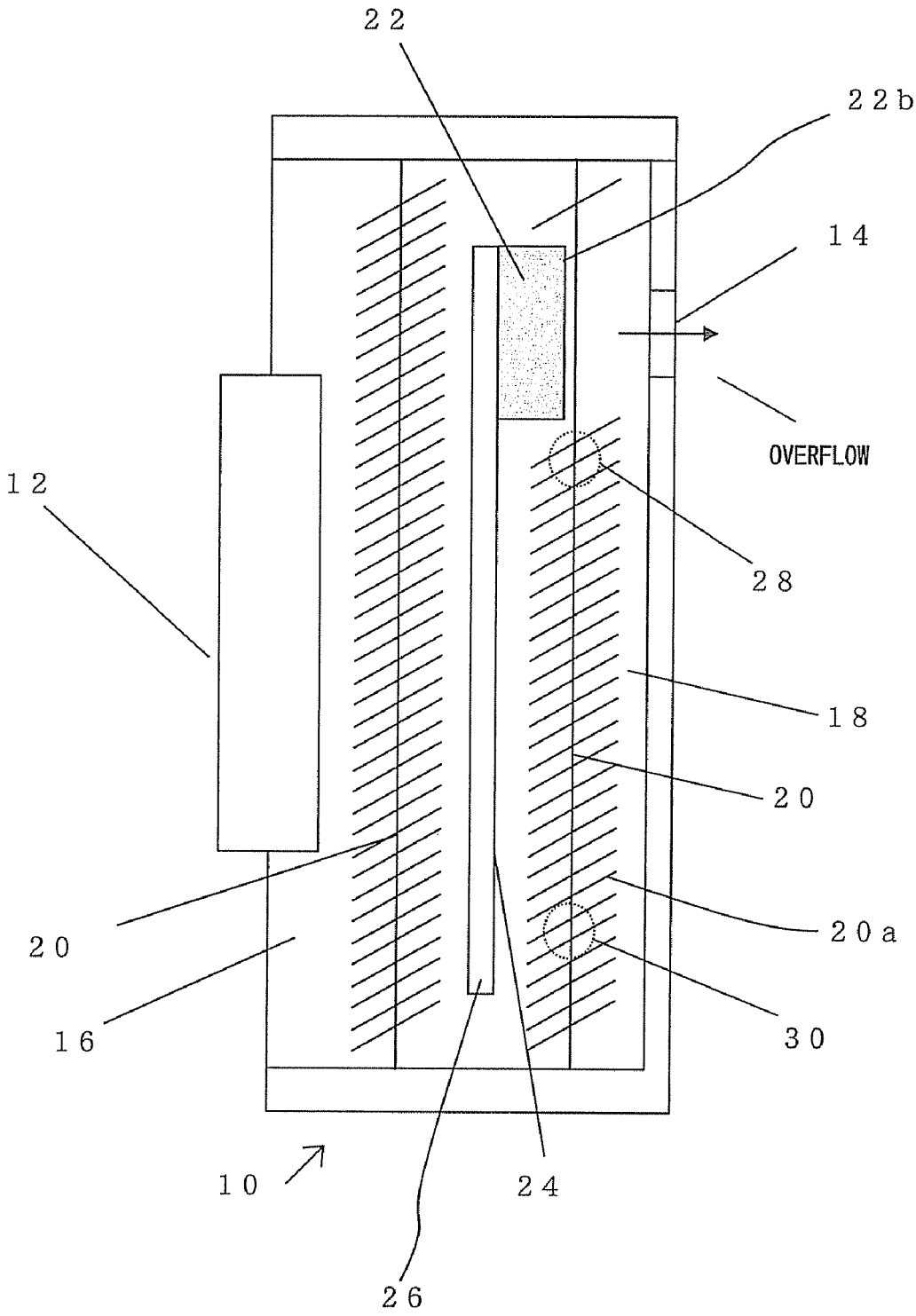
FIG. 1 is a plan view in which a developing unit of embodiment 1 is cut in the horizontal direction at the center of a discharge port in the vertical direction.
Figure 2:
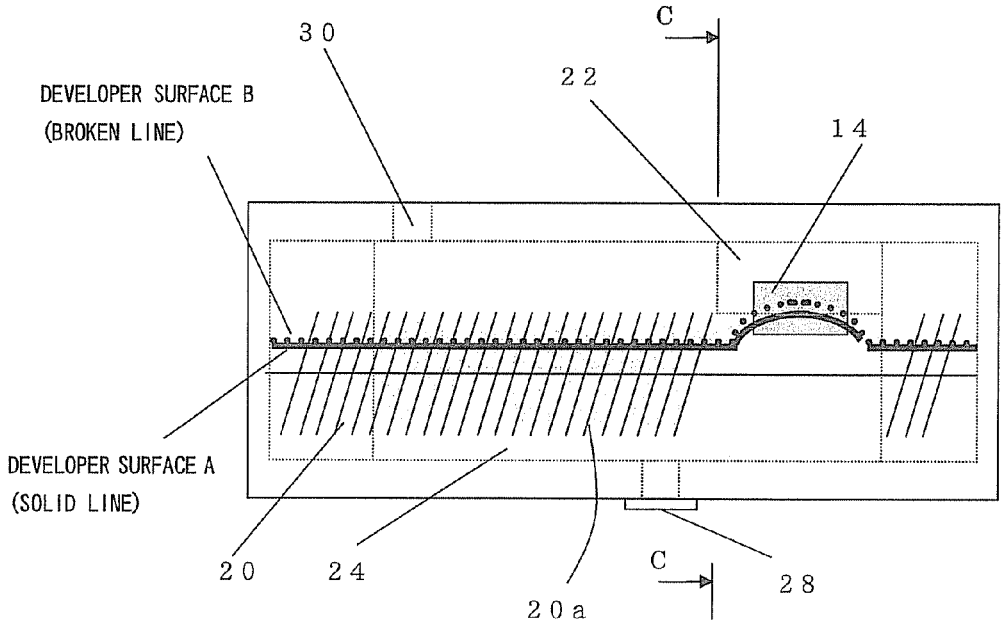
FIG. 2(*a*) is a side view of the developing unit at the discharge port side.
Figure 2:
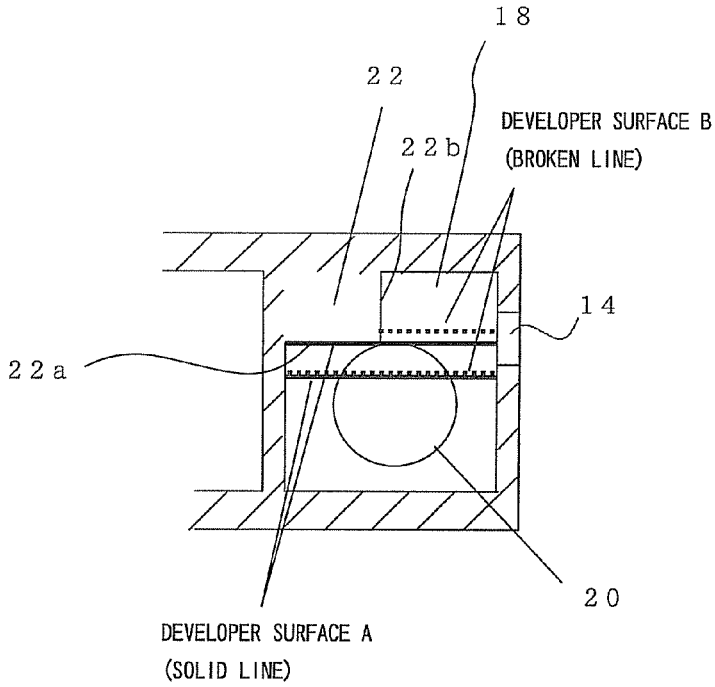
Figure 3:
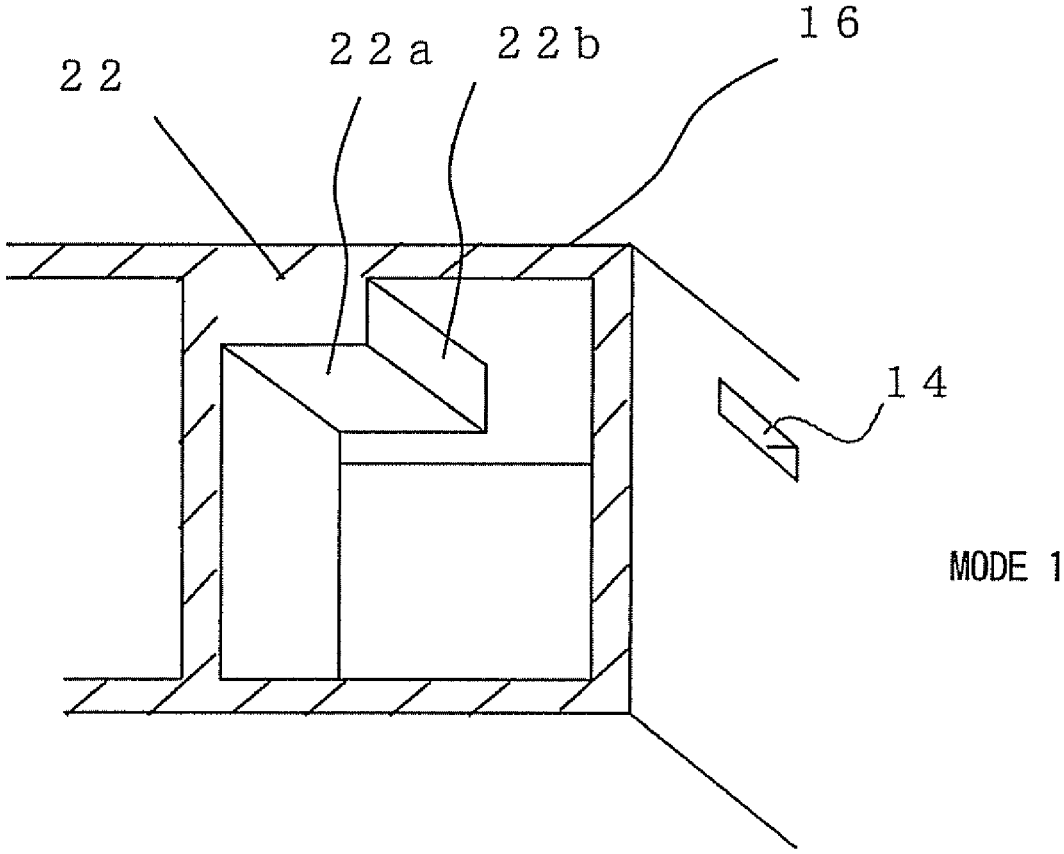
FIG. 3 is a perspective view showing only a containing unit of FIG. 2(*b*).

FIG. 1, FIG. 2 and FIG. 3 are structural views of a developing unit of embodiment 1. FIG. 1 is a plan view in which the developing unit of embodiment 1 is cut in the horizontal direction at the center of a discharge port in the vertical direction, FIG. 2(*a*) is a side view of the developing unit at the discharge port side, FIG. 2(*b*) is a C-C sectional view of FIG. 2(*a*), and FIG. 3 is a perspective view showing only a containing unit of FIG. 2(*b*).

The developing unit 10 includes a developing roller (developer supply member, developer supply means) 12, a containing unit (developer containing means) 16 to contain a developer and having a discharge port 14 for discharging the overflown developer in its side wall, a stirring and transporting member (stirring and transporting means) 20 to stir and transport the developer along a passage 18 formed in the containing unit 16, and a guide unit (guide means) 22 to guide the developer transported by the stirring and transporting member 20 in the passage 18 to the discharge port 14 side.

The discharge port 14 is provided at a position where the surplus developer is discharged to the outside of the developing unit 10 by overflow so that the amount of developer contained in the developing unit 10 can always be kept at a specified amount correspondingly to the amount of developer supplied into the developing unit 10.

The guide unit 22 is provided in the passage 18 correspondingly to the height position of the discharge port 14, and the sectional shape is rectangular when viewed in the passage 18 direction (that is, the developer transport direction, that is, the rotation axis direction of the stirring and transporting member 20). Besides, a bottom (bottom surface) 22*a* of the guide unit 22 is formed at a position higher than the lower end of the discharge port 14 in the containing unit 16, specifically, at a height position of 0 to 3 mm from the lower end of the discharge port 14. The height position of the bottom 22*a* is almost the same position as the height position of a developer surface at the time when the amount of the developer contained in the developing unit 10 is the specified amount. In the guide unit 22, a guide surface 22*b* to guide the developer is formed above the bottom 22*a*, and the guide surface 22*b* is positioned to be in parallel to the discharge port 14. The guide unit 22 is formed such that an upper wall surface in the passage 18 at a wall surface 24 side opposite to the discharge port 14 is partially lowered, and an upper wall part of the wall surface 24 opposite to the discharge port 14 in the passage 18 overhangs in the discharge port 14 direction by a specified amount. The overhang width of the guide unit 22 is set to be narrower than the passage 18 width of from the end of the overhang to the discharge port 14, and the length of the guide unit 22 in the passage 18 direction is set to be equal to or larger than at least the length of the discharge port 14 in the passage 18 direction.

The plural stirring and transporting members 20 are arranged in parallel to each other in the containing unit 16, and a partition unit (partition means) 26 is provided between the plural stirring and transporting members 20. Besides, the passage 18 is formed of the inner wall of the containing unit 16 and the side surface of the partition unit 26, and one side surface of the partition unit 26 constitutes the wall surface 24. A spiral 20*a* is provided in each of the stirring and transporting members 20, and the spiral 20*a* is rotated so that the developer is stirred and transported. The developer circulates in the containing unit 16 in the counterclockwise direction when viewed from above and the developer is supplied to the developing roller 12. The stirring and transporting member 20 at the discharge port 14 side is not provided with the spiral 20*a* in the vicinity of the discharge port 14, and since a force to stir and transport the developer is not generated in the portion where the spiral 20*a* is not provided, the developer is accumulated in this portion and is placed in a swelled state.

Besides, a toner density sensor 28 to control the density of the toner is disposed in the developing unit 10, and the toner density sensor 28 is located at a position indicated by a broken line circle of FIG. 1 on the bottom surface of the containing unit 16.

Figure 19:
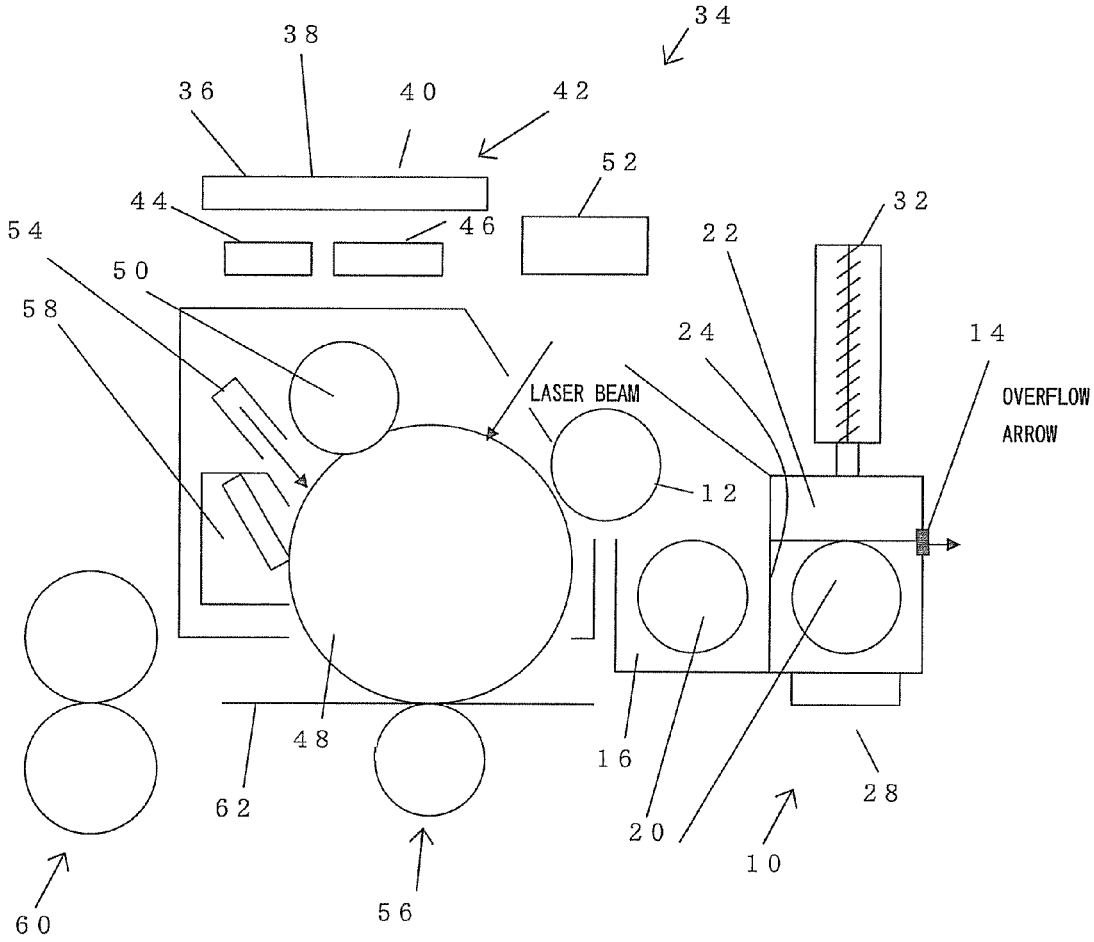
FIG. 19 is a structural view showing a copying machine as an image forming apparatus in which the developing unit of the embodiment is mounted.

Further, in the developing unit 10, a supply port 30 to supply the developer from a hopper 32 shown in FIG. 19 is disposed at a position indicated by a broken line circle of FIG. 1 in the upper part of the containing unit 16.

Next, the operation of embodiment 1 will be described.

The developer supplied from the hopper 32 through the supply port 30 into the containing unit 16 is stirred and transported along the passage 18 in the counterclockwise direction by the stirring and transporting member 20. In the case where the use environment of the developer at this time is a normal environment state, that is, in the case of room temperature and normal humidity, a developer surface A is located at a position of a solid line in FIG. 2. Incidentally, the state of room temperature and normal humidity is the state in which the temperature is about 23° C., and the humidity is about 50%. In a portion where stirring and transporting are performed by the spiral 20*a* of the stirring and transporting member 20, the upper surface of the developer is located at a position lower than the discharge port 14, and in the vicinity of the discharge port 14 in which the spiral 20*a* does not exist, the developer is accumulated and is swelled up to the position almost equal to the bottom 22*a* of the guide unit 22, and is excellently discharged through the discharge port 14.

Next, in the case where the use environment of the developer is a high humidity state, that is, in the case of the state where the humidity is 80% or more, the fluidity of the developer becomes poor, and it becomes hard to discharge through the discharge port 14. Thus, when the developer in the developing unit 10 is not increased more than that in the normal environment, it is not discharged, and therefore, the amount of developer in the developing unit 10 becomes slightly larger than that in the normal environment, and rises up to a position of a developer surface B indicated by a broken line in FIG. 2. By this, in the vicinity of the discharge port 14, the developer is swelled up to a position higher than the bottom 22*a* of the guide unit 22, however, the space of the passage 18 in the height direction is narrowed by the bottom 22*a*, and the straight movement is blocked. Thus, the developer flows in the passage 18 toward the side where the guide unit 22 is not provided, and the developer is discharged through the discharge port 14 as indicated by an arrow of FIG. 1. By this, the developer is further swelled in the portion of the discharge port 14 as compared with the structure where the guide unit 22 is not provided in the passage 18, and since the swelling effect of the developer is increased, the developer becomes easy to be discharged through the discharge port 14.

Incidentally, although the fluidity of the developer mainly relates to the humidity, even if the humidity is the same value, the fluidity becomes slightly poor in the case where the temperature is high as compared with the case where it is low.

Incidentally, with respect to embodiment 2 to embodiment 9 described below, in the case where the use state is the normal environment, the operation is the same as that of embodiment 1, and therefore, the description of the operation in the case of the normal environment will be omitted in embodiment 2 to embodiment 9. Besides, also in the case where the use environment is a high humidity, only the flow state of the developer in the vicinity of the guide unit 22 varies, and the others are the same, and therefore, only the flow state of the developer in the vicinity of the guide unit 22 will be described.

Embodiment 2

Figure 4:
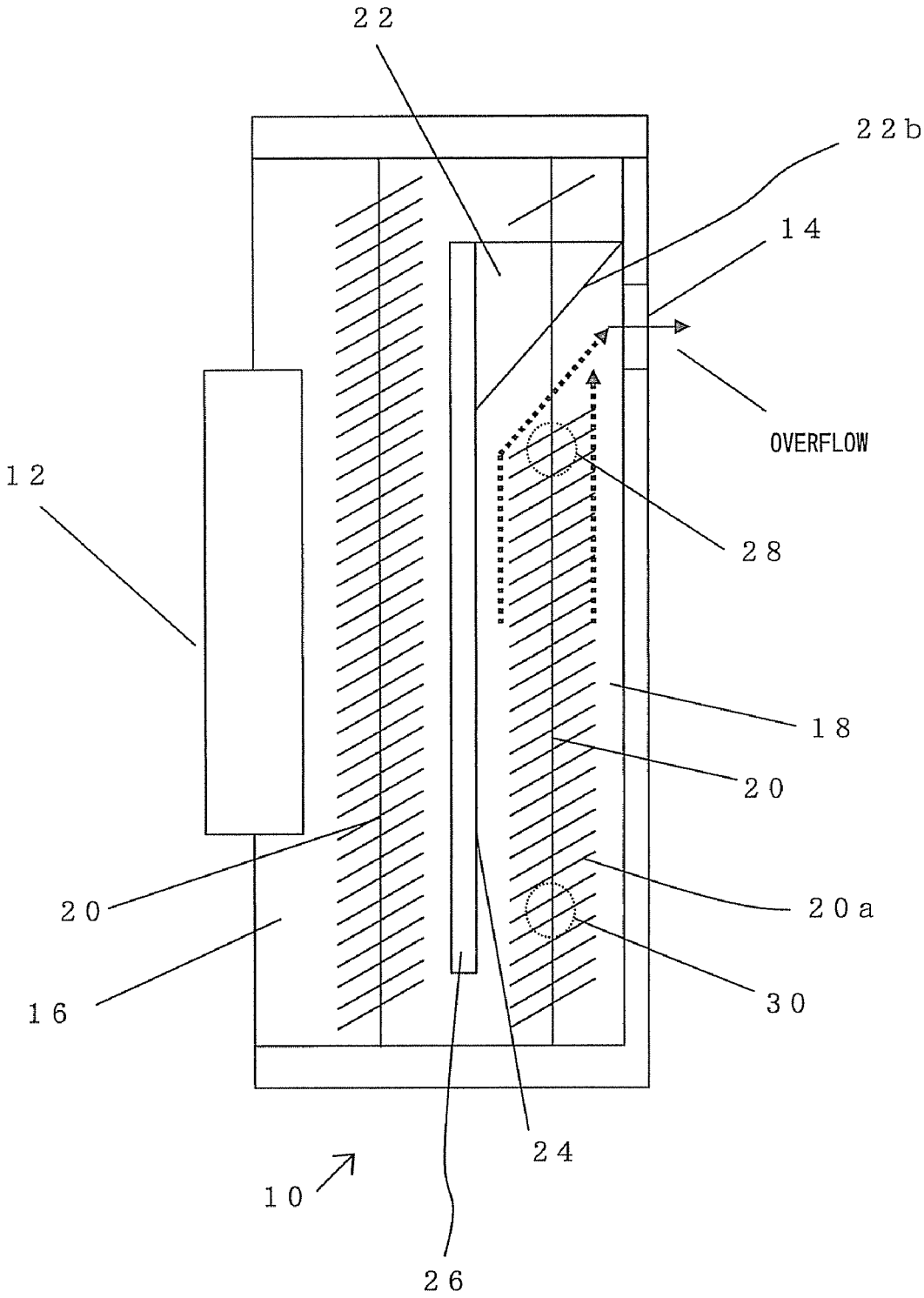
FIG. 4 is a plan view in which a developing unit of embodiment 2 is cut in the horizontal direction at the center of a discharge port in the vertical direction.
Figure 5:
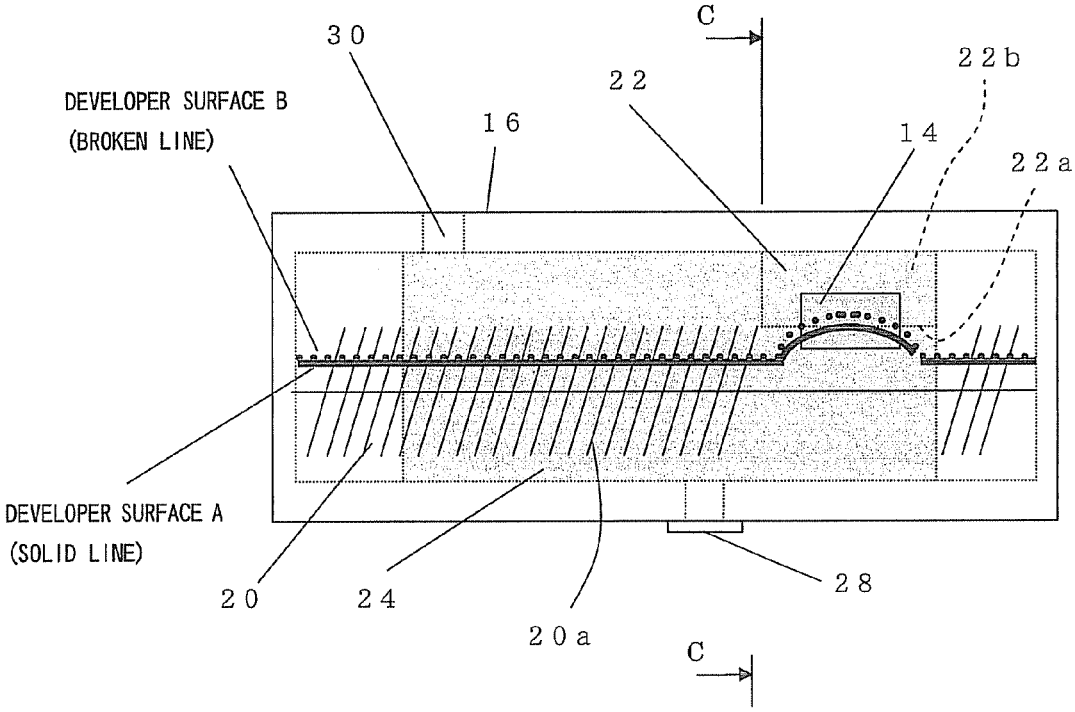
FIG. 5(*a*) is a side view of the developing unit at the discharge port side.
Figure 5:
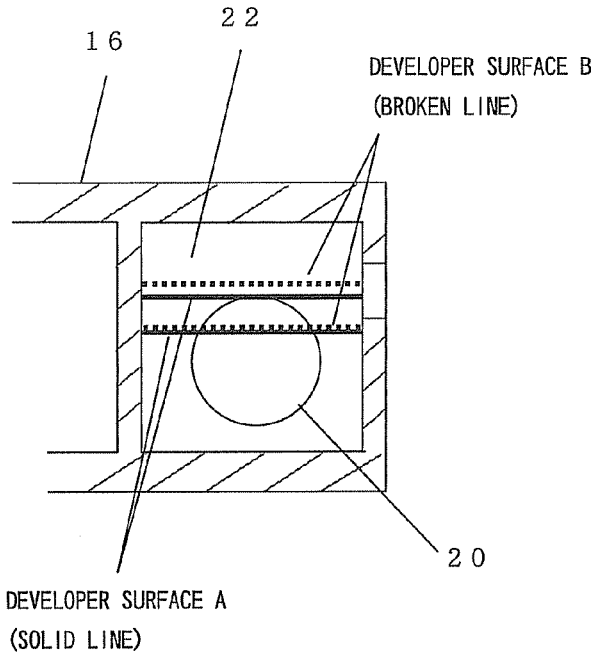
Figure 6:
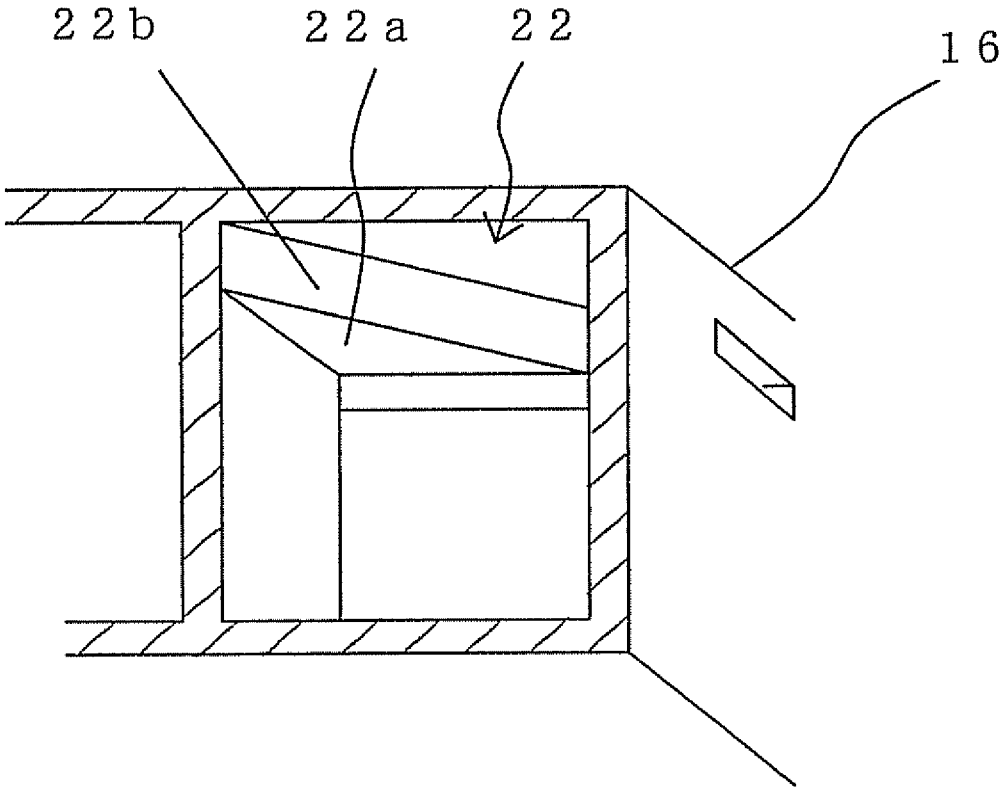
FIG. 6 is a perspective view showing only a containing unit of FIG. 5(*b*).

FIG. 4, FIG. 5 and FIG. 6 are structural views of a developing unit of embodiment 2. FIG. 4 is a plan view in which the developing unit of embodiment 2 is cut in the horizontal direction at the center of a discharge port in the vertical direction, FIG. 5(*a*) is a side view of the developing unit at the discharge port side, FIG. 5(*b*) is a C-C sectional view of FIG. 5(*a*), and FIG. 6 is a perspective view showing only a containing unit of FIG. 5(*b*). Incidentally, since a structure other than the shape of a guide unit 22 is the same as that of embodiment 1, the description of redundant portions will be omitted.

The guide unit 22 has a sectional shape which is a triangular shape when viewed from above, and is formed to overhang the whole length of a passage 18 in a width direction. A guide surface 22*b* forms an inclined surface such that an end at a wall surface 24 side is positioned at an upstream side when viewed in the passage 18 direction, and an end at a side wall side of a containing unit 16 is positioned at a downstream side.

Since other structure is the same as that of embodiment 1, the description will be omitted.

Next, the operation of embodiment 2 will be described.

In the case where the use environment is a high humidity state, the developer flowing to the vicinity of the guide unit 22 is prevented from going straight ahead since the space of the passage 18 in the height direction is narrowed by a bottom 22*a* of the guide unit 22, and flows in the passage 18 direction between the guide surface 22*b* and the containing unit 16. In addition, since the guide surface 22*b* is inclined to a discharge port 14 side, the developer flowing to the passage 18 between the guide surface 22*b* and the containing unit 16 is guided to the discharge port 14 direction by the guide surface 22*b*. By this, as indicated by a broken line of FIG. 4, although the developer in the vicinity of the side wall of the containing unit 16 goes straight ahead, the developer flowing in a portion other than that flows to the discharge port 14 direction along the guide surface 22*b*. Finally, the developer going straight ahead is also pushed out by the guided developer and flows to the discharge port 14 direction.

As stated above, in addition to the effect of the guide unit of embodiment 1, since the guide unit 22*b* of embodiment 2 has the structure to cause the flow of the developer toward the discharge port 14 side, the developer becomes easy to be discharged, and as compared with the guide unit 22 of embodiment 1, the increase of the developer in the developing unit 10 can be further suppressed.

Embodiment 3

Figure 7:
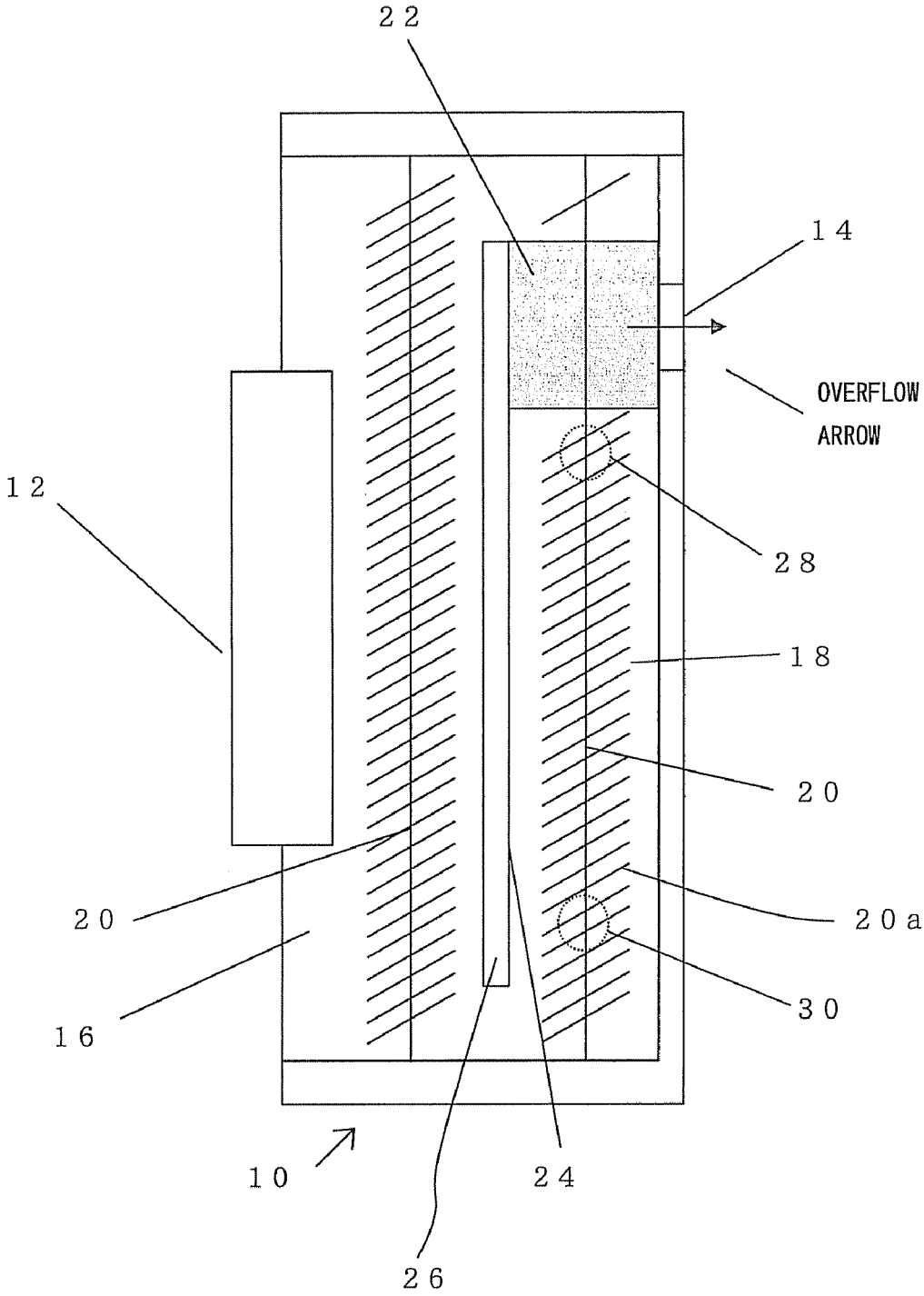
FIG. 7 is a plan view in which a developing unit of embodiment 3 is cut in the horizontal direction at the center of a discharge port in the vertical direction.
Figure 8:
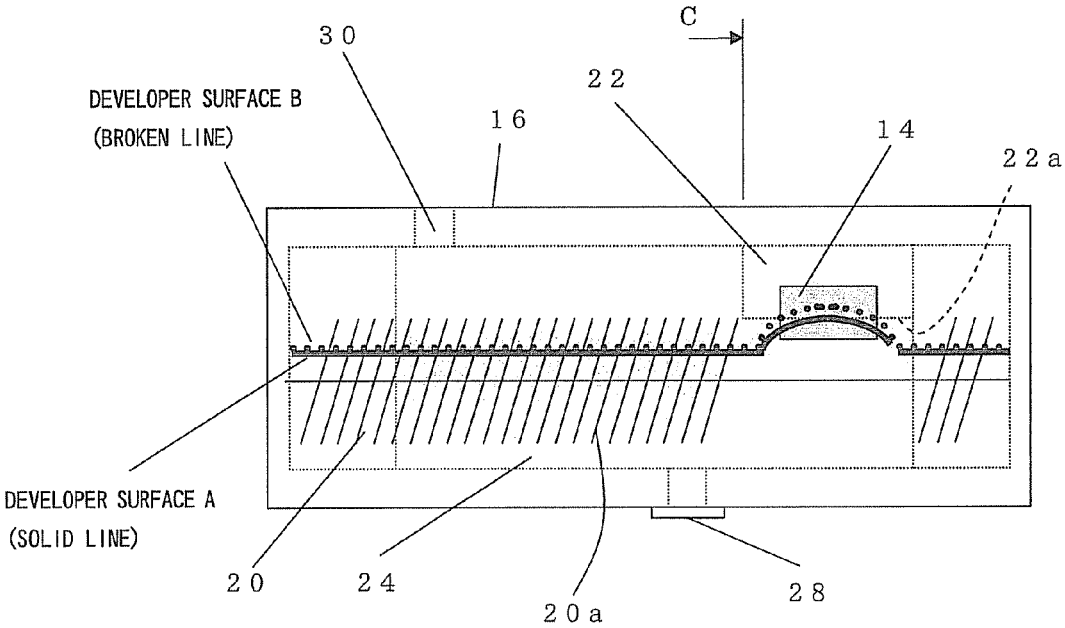
FIG. 8(*a*) is a side view of the developing unit at the discharge port side.
Figure 8:
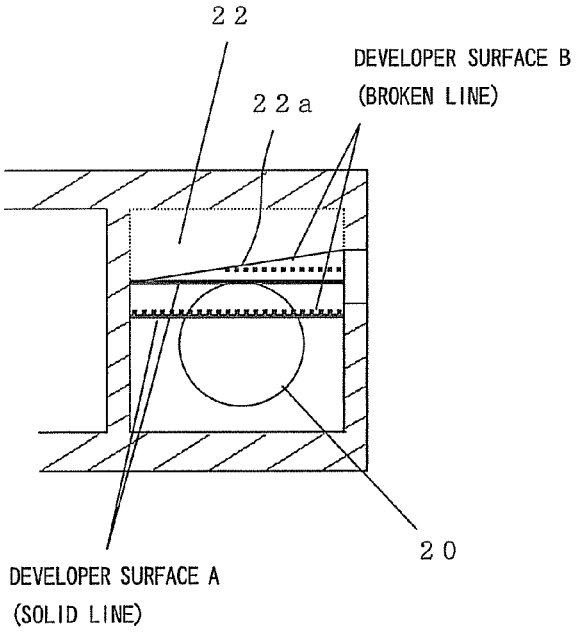
Figure 9:
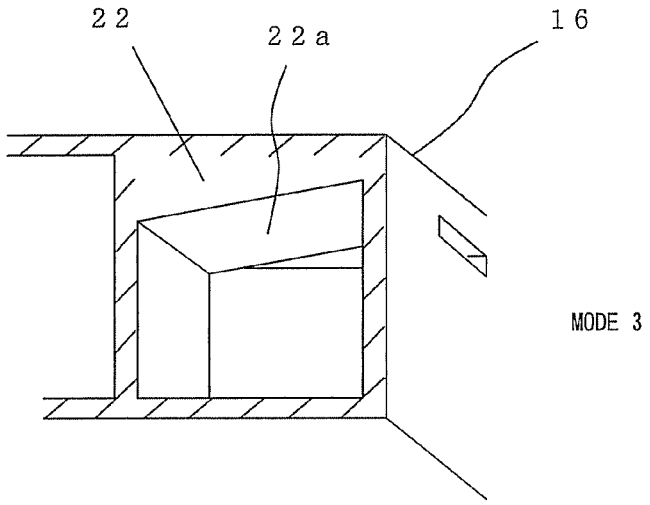
FIG. 9 is a perspective view showing only a containing unit of FIG. 8(*b*).

FIG. 7, FIG. 8 and FIG. 9 are structural views of a developing unit of embodiment 3. FIG. 7 is a plan view in which the developing unit of embodiment 3 is cut in the horizontal direction at the center of a discharge port in the vertical direction, FIG. 8(*a*) is a side view of the developing unit at the discharge port side, FIG. 8(*b*) is a C-C sectional view of FIG. 8(*a*), and FIG. 9 is a perspective view showing only a containing unit of FIG. 8(*b*). Incidentally, since a structure other than the shape of a guide unit 22 is the same as that of embodiment 1, the description of redundant portions will be omitted.

The guide unit 22 is formed to overhang the whole length of a passage 18 in a width direction so that a bottom (bottom surface) 22*a* is inclined upward to a discharge port 14 side when viewed in the passage 18 direction. An inclined surface is formed such that a height direction position of the bottom 22*a* is lowest at an end on a wall surface 24 side and is highest at an end on a side wall side of a containing unit 16, and the height position of the bottom 22*a* at the end on the side wall side of the containing unit 16 is the same position as the upper end of the discharge port 14. In this case, the bottom 22*a* of the guide unit 22 functions as the guide surface.

Since other structure is the same as that of embodiment 1, the description will be omitted.

Next, the operation of embodiment 3 will be described.

In the case where the use environment is a high humidity state, in a portion where the height position of the bottom 22*a* is low, the space of the passage 18 in the height direction is narrowed by the bottom 22*a*, and the developer flowing to the vicinity of the guide unit 22 is prevented from going straight ahead, and is pushed toward a part where the height position of the bottom 22*a* is high. Since the height position of the bottom 22*a* of the guide unit 22 is high at the discharge port 14 side and is low at the wall surface 24 side, the developer is pushed toward the discharge port 14 side, and the swelling effect at the discharge port 14 side is increased. By this, the developer becomes easy to be discharged through the discharge port 14.

Embodiment 4

Figure 10:
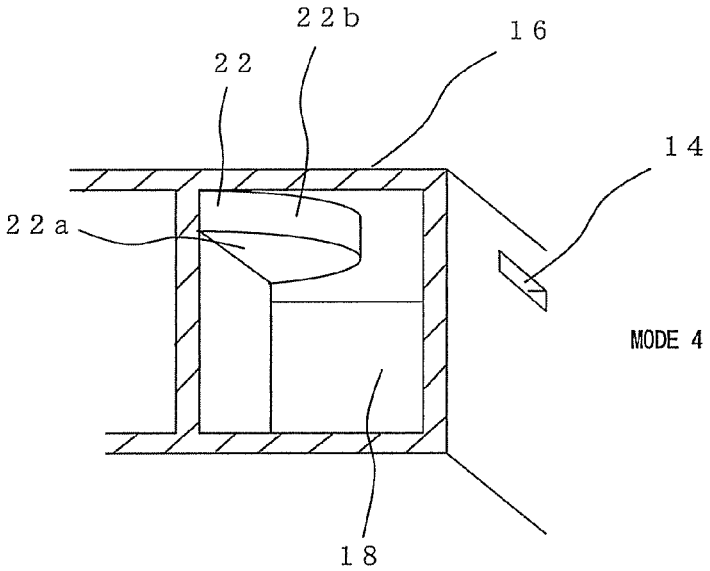
FIG. 10 is a perspective view of a containing unit showing a guide unit of embodiment 4.

FIG. 10 is a perspective view of a containing unit showing a guide unit of embodiment 4. Incidentally, since a structure other than the shape of a guide unit 22 is the same as that of embodiment 1, the description of redundant portions will be omitted.

The guide unit 22 has a semicylindrical shape in which a sectional shape is a semicircular shape when viewed from above, and is formed such that a wall surface 24 opposite to a discharge port 14 in a passage 18 overhangs by a specified amount in the discharge port 14 direction.

Since other structure is the same as embodiment 1, the description will be omitted.

Next, the operation of embodiment 4 will be described.

The overhang of the guide unit 22 of embodiment 4 is up to a halfway position of the passage 18 in the width direction similarly to embodiment 1, and a bottom 22*a* is horizontal similarly to embodiment 1 and embodiment 2. Besides, since a guide surface 22*b* is constructed of a semicircular circumference, similarly to the guide surface 22*b* of the guide unit 22 of embodiment 2, it has a structure inclined in the discharge port 14 direction, and therefore, the same operation and effect as those of embodiment 1 and embodiment 2 can be obtained.

Embodiment 5

Figure 11:
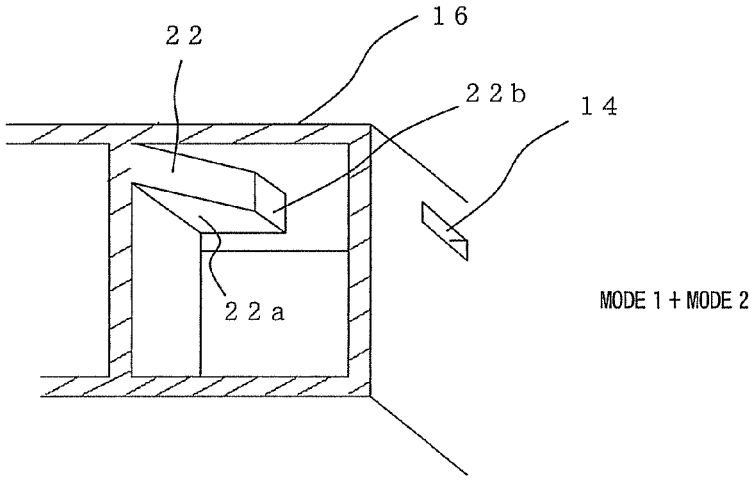
FIG. 11 is a perspective view of a containing unit showing a guide unit of embodiment 5.

FIG. 11 is a perspective view of a containing unit showing a guide unit of embodiment 5. Incidentally, since a structure other than the shape of a guide unit 22 is the same as that of embodiment 1, the description of redundant portions will be omitted.

The guide unit 22 has a sectional shape which is a trapezoidal shape when viewed from above, and is shaped such that a wall surface 24 opposite to a discharge port 14 in a passage 18 overhangs by a specified amount in the discharge port 14 direction. A bottom 22*a* is horizontal similarly to embodiment 1 and embodiment 2.

Since other structure is the same as that of embodiment 1, the description will be omitted.

Next, the operation of embodiment 5 will be described.

The overhang of the guide unit 22 of embodiment 5 is up to a halfway position in the width direction of a passage 18 similarly to embodiment 1, and the bottom 22*a* is horizontal similarly to embodiment 1 and embodiment 2. Besides, since a guide surface 22*b* is structured to have an inclined surface similar to that of embodiment 2, the same operation and effect as those of embodiment 1 and embodiment 2 can be obtained.

Embodiment 6

Figure 12:
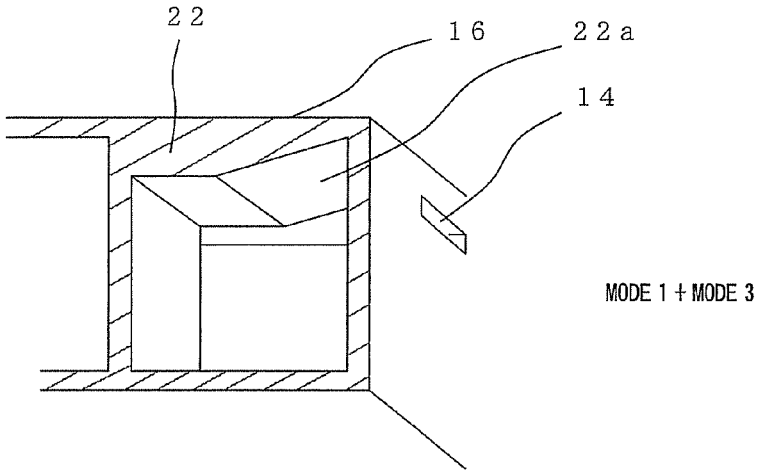
FIG. 12 is a perspective view of a containing unit showing a guide unit of embodiment 6.

FIG. 12 is a perspective view of a containing unit showing a guide unit of embodiment 6. Incidentally, since a structure other than the shape of a guide unit 22 is the same as that of embodiment 1, the description of redundant portions will be omitted.

The guide unit 22 has a sectional shape which is an inverted trapezoidal shape when viewed in a passage 18 direction, and is formed to overhang the whole length of the passage 18 in the width direction. The guide unit 22 has the same structure as that of embodiment 1 from a wall surface 24 to a halfway position of the passage 18 in the width direction, and has the same structure as that of embodiment 3 from the halfway position of the passage 18 in the width direction to a side wall of a containing unit 16. Accordingly, a bottom 22*a* of the guide unit 22 is horizontal from the wall surface 24 to the halfway position of the passage 18 in the width direction and is an inclined surface which rises from the halfway position of the passage 18 in the width direction to the side wall direction of the containing unit 16.

Since other structure is the same as that of embodiment 1, the description will be omitted.

Next, the operation of embodiment 6 will be described.

As described above, since the guide unit 22 of embodiment 6 has the same structure as that of embodiment 1 from the wall surface 24 to the halfway position of the passage 18 in the width direction, and has the same structure as that of embodiment 3 from the halfway position of the passage 18 in the width direction to the side wall of the containing unit 16, the same operation and effect as those of embodiment 1 and embodiment 3 can be obtained.

Embodiment 7

Figure 13:
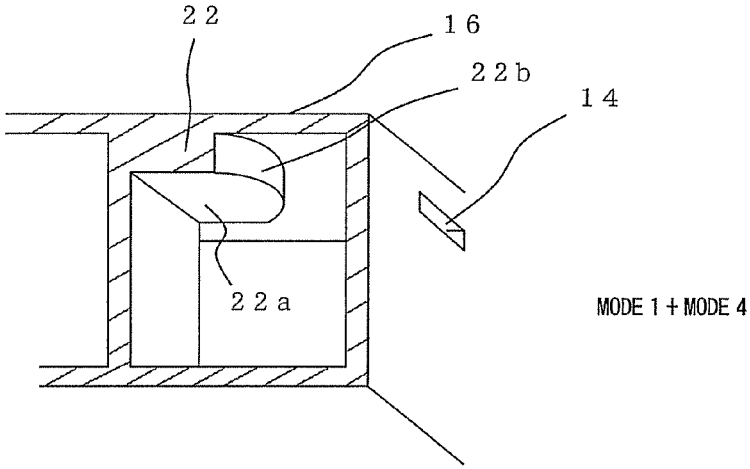
FIG. 13 is a perspective view of a containing unit showing a guide unit of embodiment 7.

FIG. 13 is a perspective view of a containing unit showing a guide unit of embodiment 7. Incidentally, since a structure other than the shape of a guide unit 22 is the same as that of embodiment 1, the description of redundant portions will be omitted.

The guide unit 22 is formed such that a wall surface 24 opposite to a discharge port 14 in a passage 18 overhangs by a specified amount in the discharge port 14 direction, has the same structure as that of embodiment 1 from the wall surface 24 to a halfway position of the passage 18 in the width direction, and has the same structure as that of embodiment 4 from the halfway position of the passage 18 in the width direction.

Since other structure is the same as that of embodiment 1, the description will be omitted.

Next, the operation of embodiment 7 will be described.

As described above, since the guide unit 22 of embodiment 7 has the same structure as that of embodiment 1 from the wall surface 24 to the halfway position of the passage 18 in the width direction, and has the same structure as that of embodiment 4 from the halfway position of the passage 18 in the width direction, the same operation and effect as those of embodiment 1 and embodiment 4 can be obtained.

Embodiment 8

Figure 14:
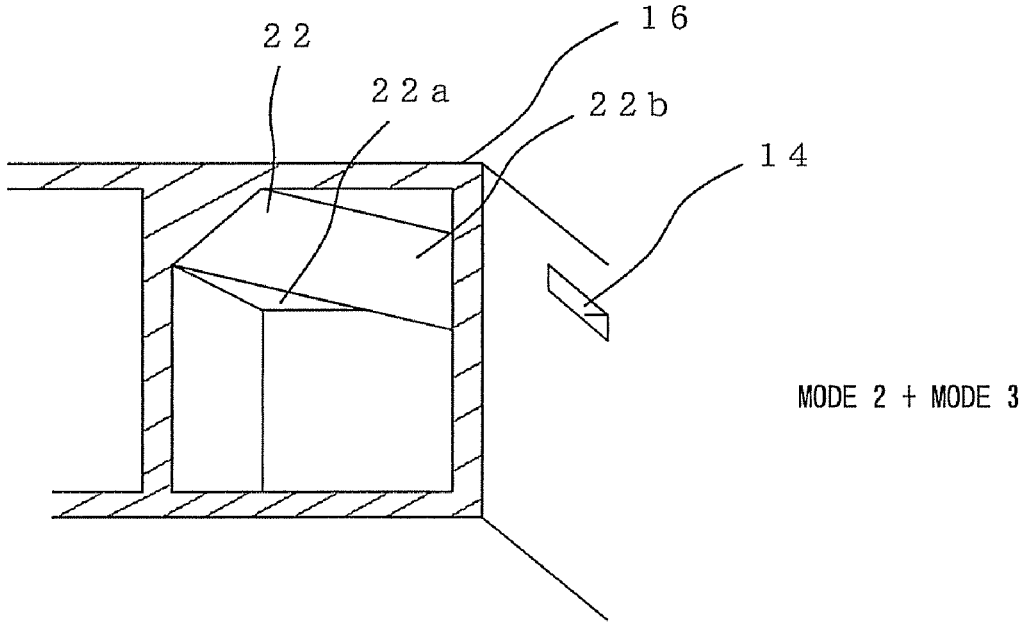
FIG. 14 is a perspective view of a containing unit showing a guide unit of embodiment 8.

FIG. 14 is a perspective view of a containing unit showing a guide unit of embodiment 8. Incidentally, since a structure other than the shape of a guide unit 22 is the same as that of embodiment 1, the description of redundant portions will be omitted.

The guide unit 22 is formed to overhang the whole length of a passage 18 in the width direction, a bottom 22*a* has the same structure as that of embodiment 3, and a guide surface 22*b* has the same structure as that of embodiment 2.

Since other structure is the same as embodiment 1, the description will be omitted.

Next, the operation of embodiment 8 will be described.

In the guide unit 22 of embodiment 8, as described above, since the bottom 22*a* has the same structure as that of embodiment 3 and the guide surface 22*b* has the same structure as that of embodiment 2, the same operation and effect as those of embodiment 3 and embodiment 2 can be obtained.

Embodiment 9

Figure 15:
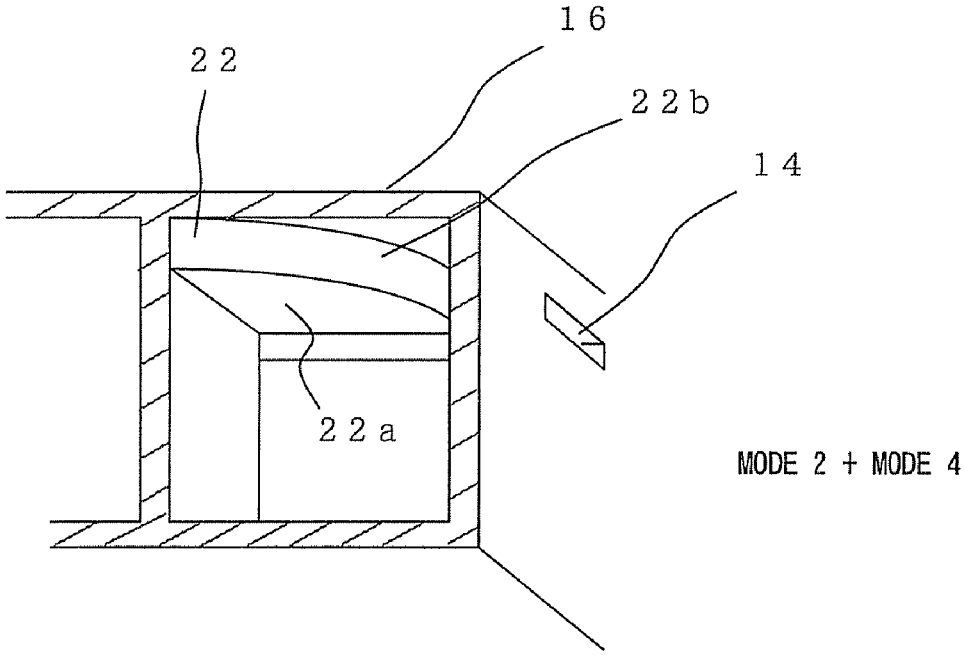
FIG. 15 is a perspective view of a containing unit showing a guide unit of embodiment 9.

FIG. 15 is a perspective view of a containing unit 16 showing a guide unit 22 of embodiment 9. Incidentally, since a structure other than the shape of a guide unit 22 is the same as embodiment 1, the description of redundant portions will be omitted.

The guide unit 22 is formed to overhang the whole length of a passage 18 in the width direction, and has a fan-like shape in a sectional view when viewed from above.

Since other structure is the same as embodiment 1, the description will be omitted.

Next, the operation of embodiment 9 will be described.

As described above, the guide unit 22 of embodiment 9 has the fan-like shape in the sectional view when viewed from above, and this is the structure in which the width of the passage 18 is gradually narrowed in a discharge port 14 direction from the upstream side to the downstream side when viewed in the passage 18 direction, and is almost the same structure as that of embodiment 2 though there is a difference between an arc shape and a straight-line shape. Besides, a guide surface 22*b* is arc-shaped similarly to embodiment 4, and by this, the same operation and effect as those of embodiment 2 and embodiment 4 can be obtained.

Incidentally, although the guide unit 22 of from embodiment 1 to embodiment 9 is formed such that the upper wall surface in the passage 18 at the wall surface 24 side opposite to the discharge port 14 is partially lowered, no limitation is made to this shape. For example, the shape may be such that the wall surface 24 projects in the discharge port 14 direction, and a gap is formed between the upper surface of the guide unit 22 and the upper wall surface.

Embodiment 10

Figure 16:
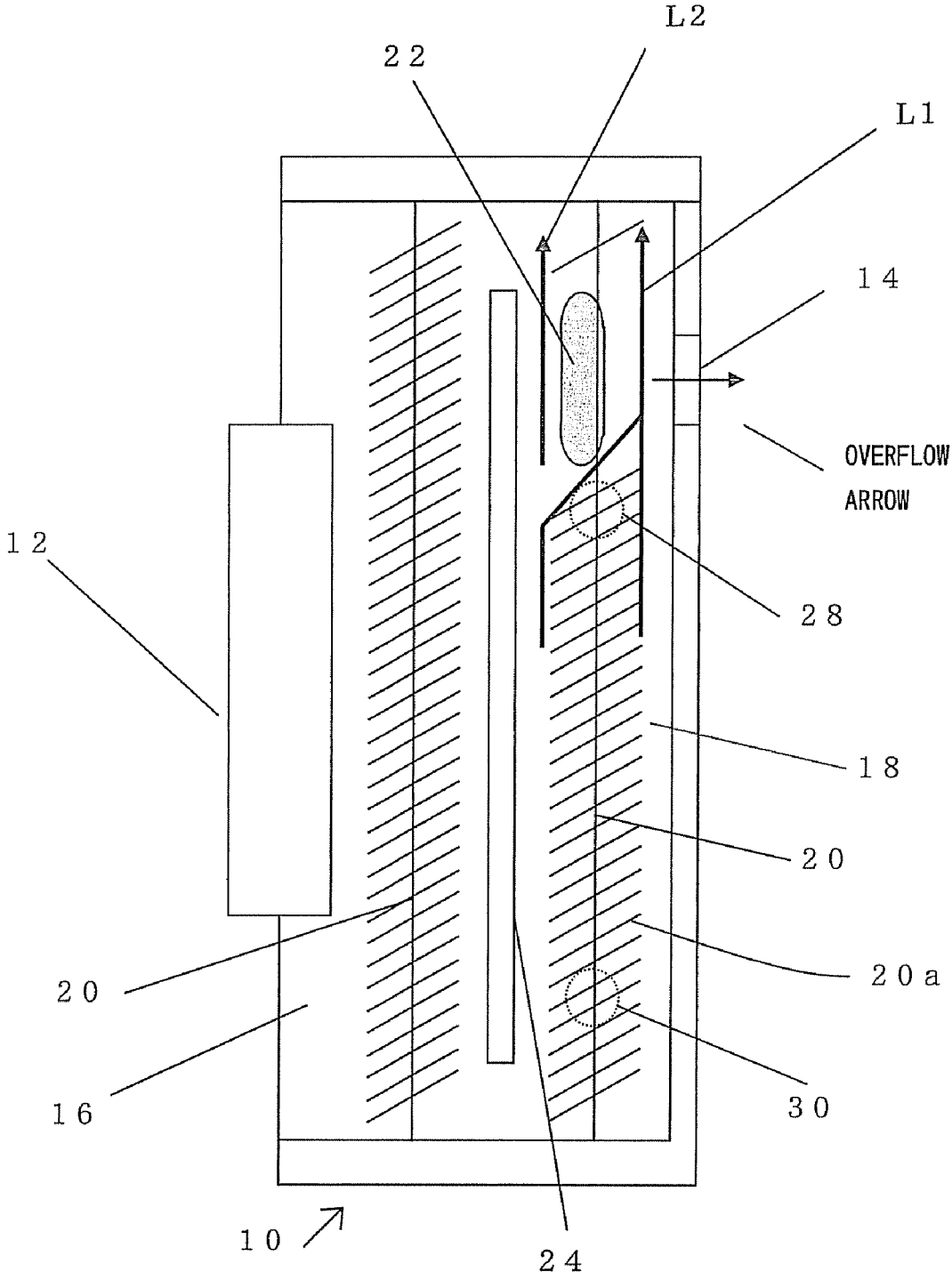
FIG. 16 is a plan view in which a developing unit of embodiment 10 is cut in the horizontal direction at the center of a discharge port in the vertical direction.
Figure 17:
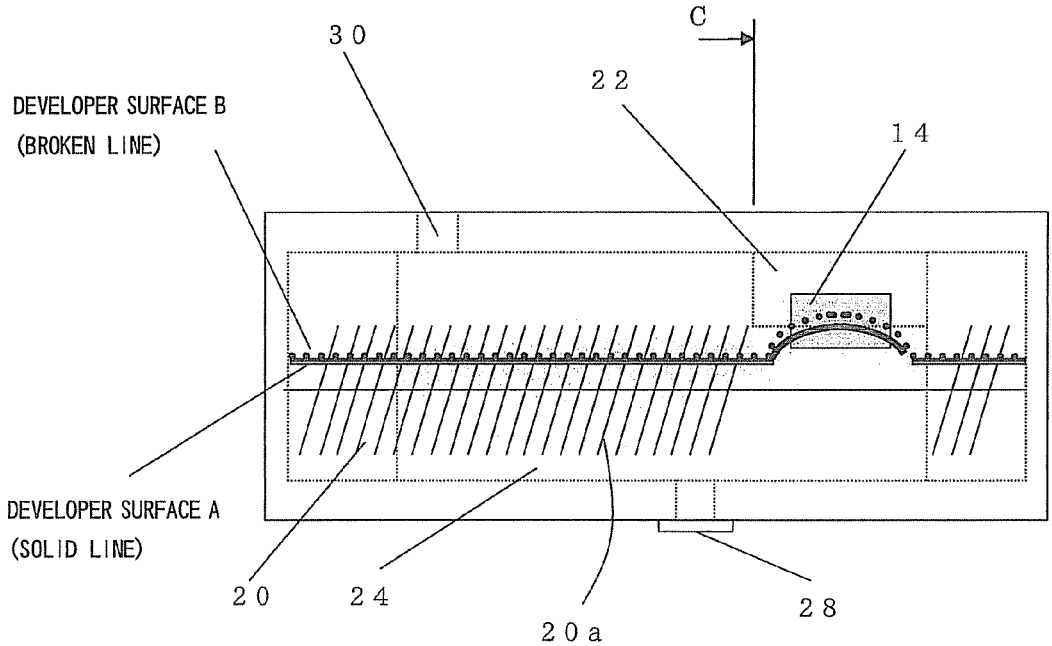
FIG. 17(*a*) is a side view of the developing unit at the discharge port side.
Figure 17:
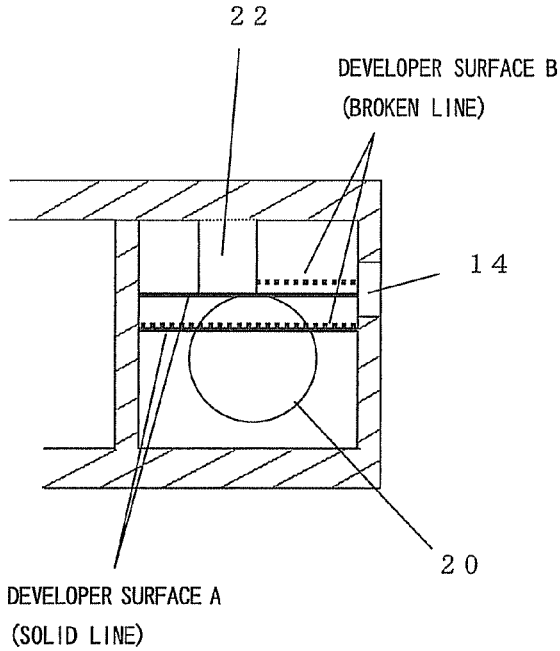
Figure 18:
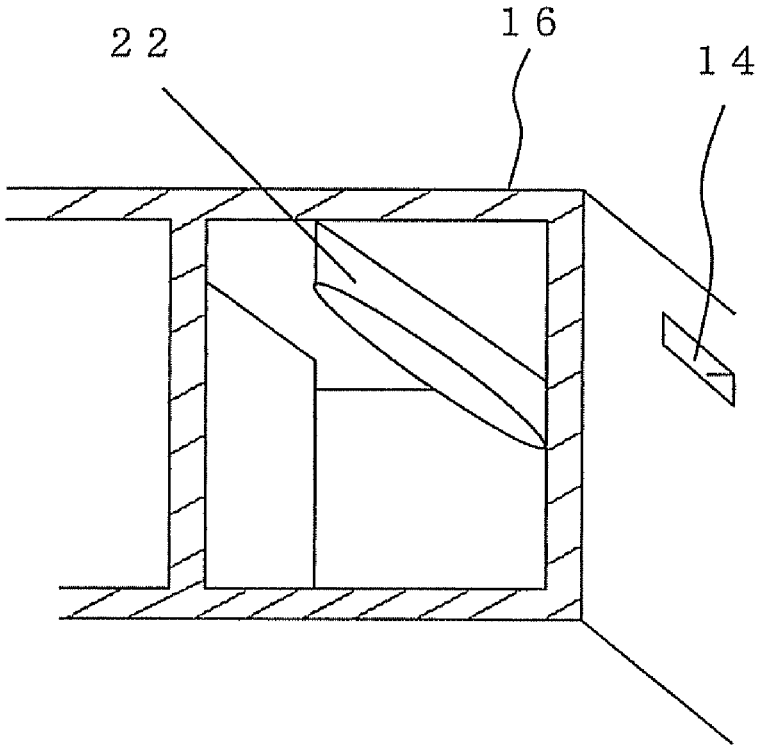
FIG. 18 is a perspective view showing only a containing unit of FIG. 17(*b*).

FIG. 16, FIG. 17 and FIG. 18 are structural views of a developing unit of embodiment 10. FIG. 16 is a plan view in which a developing unit of embodiment 10 is cut in the horizontal direction at the center of a discharge port in the vertical direction, FIG. 17(*a*) is a side view of the developing unit at the discharge port side, FIG. 17(*b*) is a C-C sectional view of FIG. 17(*a*), and FIG. 18 is a perspective view showing only a containing unit of FIG. 17(*b*). Incidentally, since a structure other than the shape of the guide unit 22 is the same as that of embodiment 1, the description of redundant portions will be omitted.

The guide unit 22 is formed of a projection projecting from an upper wall surface of a passage 18, and is formed to have a specified length in a passage direction so that an upper part of the passage 18 is divided by the guide unit 22 into a part at a discharge port 14 side and a part at a wall surface 24 side opposite to the discharge port 14. The length of the guide unit 22 is set to be longer than at least the length of the discharge port 14 in the passage direction similarly to embodiment 1. Besides, the guide unit 22 is provided so that the width of a passage L2 at the wall surface 24 side in the passage 18 is narrower than the width of a passage L1 at the discharge port 14 side.

Since other structure is the same as that of embodiment 1, the description will be omitted.

Next, the operation of embodiment 10 will be described.

In embodiment 10, only the flow state of a developer in the vicinity of the guide unit 22 is different from that of embodiment 1, and the others are same, and accordingly, only the flow state of the developer in the vicinity of the guide unit 22 will be described.

In the case where the use environment of the developer is the normal environmental state, the developer flowing to the vicinity of the guide unit 22 is divided by the guide unit 22, however, since the fluidity of the developer is excellent, the developer smoothly flows in the passage L1 and the passage L2, and the developer is excellently discharged through the discharge port 14.

Next, in the case where the use environment of the developer is a high humidity state, since the fluidity of the developer is poor, as indicated by an arrow in FIG. 16, the developer flowing to the vicinity of the guide unit 22 flows more to the passage L1 which has the wide passage width and facilitates the flow as compared with the passage L2. By this, a developer surface B (FIG. 17) at the discharge port 14 side rises, and the flow of the developer toward the discharge port 14 occurs by the split flow by the guide unit 22. By this, since the developer becomes easy to be discharged through the discharge port 14, even in the state where the use environment is the high humidity and the fluidity of the developer is poor, it can be excellently discharged.

Next, based on FIG. 19, a copying machine as an image forming apparatus in which the developing unit 10 of the embodiment is mounted will be described.

A copying machine 34 includes a combination panel 42 provided with a copy button 36 for copying, a copy number button 38 to input the number of copies, a display 40 to display information of the copying machine 34, and the like. In addition, there are provided a CPU 44 to control copying, a memory 46 to store data necessary for performing the control, a photoconductive body (image bearing body, image bearing means) 48, a charging device (charging unit, charging means) 50 to charge the photoconductive body 48, an exposure device (electrostatic latent image forming unit, electrostatic latent image forming means) 52 to form an electrostatic latent image on the photoconductive body 48, the developing unit 10 to supply a developer to the electrostatic latent image by a developing roller 12 and to develop the electrostatic latent image, an electricity removal device 54 to remove electricity on the surface of the photoconductive body 48, a transfer device (transfer unit, transfer means) 56 to transfer a toner image from the photoconductive body 48 to a sheet (transfer member) 62, a cleaner device (cleaning unit) 58 to remove residual toner on the photoconductive body 48 by a blade, and a fixing device (fixing unit, fixing means) 60 to fix the toner to the sheet 62.

A process cartridge is constructed of at least one of the developing unit 10, the charging device 50 and the cleaner device 58 and the photoconductive body 48, and the process cartridge is detachably mounted to a main body of the copying machine 34.

Next, the operation at the time of recording will be described.

When the number of copies is inputted by the copy number button 38 of the combination panel 42, and the copy button 36 is pressed, the operation of image formation starts based on image information from a not-shown scanner.

The surface of the photoconductive body 48 is charged by the charging device 50 under the control of the CPU 44, exposure according to an image is performed by the exposure device 52, and an electrostatic latent image is formed on the photoconductive body 48. The electrostatic latent image on the photoconductive body 48 is developed by the developer on the developing roller 12 of the developing unit 10, and a developer image is formed on the photoconductive body 48. The developer always well stirred by the stirring and transporting member 20 is transported to the developing roller 12.

The developer image formed on the photoconductive body 48 is electrostatically transferred by the transfer device 56 onto the transported sheet 62, and next, it is fixed to the sheet 62 by heat and press in the fixing device 60. By this, a specified image is formed.

Besides, with respect to the photoconductive body 48 after the transfer to the sheet 62, the residual toner is removed by the cleaner device 58 having a blade, and electricity is removed by light irradiation from the electricity removal device 54.

The operation is repeated by the inputted number of copies and the copying is ended.

Toner of an amount equivalent to the consumption by the development is supplied from the hopper 32 into the developing unit 10. Thus, although a trace amount of carrier is supplied at the same time as the toner, the increase is discharged through the discharge port 14 by overflow, and is stored in a not-shown waste developer container. As stated above, the deteriorated developer is replaced by a new developer, so that the developing performance is kept and a reduction in picture quality can be suppressed.

Besides, in this embodiment, the toner density in the developing unit 10 is detected by a toner density sensor 28 to perform magnetic detection, the supply amount of toner is determined according to the output of the toner density sensor 28, and the supply amount of developer is controlled.

The respective operations are repeated, and the copying is performed.

Although the invention has been described with the specific aspect, it would be obvious for one skilled in the art that various modifications and improvements can be made insofar as they do not depart from the spirit and scope of the invention.

As described above in detail, according to the invention, it is possible to provide the developing unit and the developer stirring and transporting method in which the amount of developer in the developing unit can always be kept at a specified amount without being influenced by the use environment.

What is claimed is:

1. A developing unit, comprising:

a developer supply member configured to supply a developer to an image bearing body;

a containing unit configured to contain the developer supplied to the developer supply member, the containing unit having a passage inside and having a discharge port to discharge outside the overflown developer;

a stirring and transporting member configured to stir and transport the developer along the passage; and a guide unit provided in the passage and located directly opposite to the discharge port, configured to guide the developer transported in the passage by the stirring and transporting member towards the discharge port by narrowing the space of the passage corresponding to the discharge port.

2. A developing unit, comprising:

a developer supply member configured to supply a developer to an image bearing body;

a containing unit configured to contain the developer supplied to the developer supply member, the containing unit having a passage inside and having a discharge port to discharge outside the overflown developer;

a stirring and transporting member configured to stir and transport the developer along the passage; and a guide unit provided in the passage opposite to the discharge port, the guide unit and the discharge port face each other, and the guide unit configured to guide the developer transported in the passage by the stirring and transporting member towards the discharge port by narrowing the space of the passage corresponding to the discharge port.

3. The developing unit of claim 1, wherein the plural stirring and transporting members are disposed in parallel to each other in the containing unit, a partition unit is provided between the plural stirring and transporting members, and the passage is formed of an inner wall of the containing unit and a side surface of the partition unit.

4. The developing unit of claim 1, wherein the guide unit has a sectional shape which is a rectangular shape when viewed in a direction of the passage.

5. The developing unit of claim 1, wherein the guide unit has a sectional shape which is a triangular shape when viewed from above.

6. The developing unit of claim 1, wherein the guide unit has a sectional shape which is an inverted trapezoidal shape when viewed in a direction of the passage.

7. The developing unit of claim 1, wherein the guide unit has a sectional shape which is a partial shape of a circle or an ellipse when viewed from above.

8. The developing unit of claim 1, wherein a bottom of the guide unit is inclined upward toward the side of the discharge port when viewed in a direction of the passage.

9. A developer stirring and transporting method comprising:

stirring and transporting a developer contained in a container;

guiding the developer flowing in the container to a discharge port of the container by using a guide unit, the guide unit provided in the container surface located directly opposite to the container surface comprising the discharge port and narrowing the space of the passage corresponding to the discharge port; and discharging the developer through a discharge port.

* * * * *